United States Patent [19]

Stubblefield, Jr.

[11] 3,974,622

[45] Aug. 17, 1976

[54] APPARATUS AND METHOD FOR REPRESSURIZING HOLLOW VALVELESS ARTICLES

[76] Inventor: Fred H. Stubblefield, Jr., 2618 Merrywood Road, Charlotte, N.C. 28210

[22] Filed: June 30, 1975

[21] Appl. No.: 591,880

[52] U.S. Cl. ..... 53/7; 53/88; 156/94; 156/145

[51] Int. Cl.[2] ..... B65B 31/04

[58] Field of Search ..... 53/7, 22 R, 79, 81, 53/88, 112 R; 156/94, 145, 146, 147; 273/61 D; 29/401 B, 401 C

[56] References Cited

UNITED STATES PATENTS

| | | | |
|---|---|---|---|
| 1,159,932 | 11/1915 | Green | 156/145 |
| 2,819,573 | 1/1958 | Whittington | 53/79 X |
| 3,699,739 | 10/1972 | Burdwood | 53/88 X |

*Primary Examiner*—Travis S. McGehee
*Attorney, Agent, or Firm*—Bell, Seltzer, Park & Gibson

[57] ABSTRACT

An apparatus and method for repressurizing hollow valveless articles such as tennis balls and the like in which an article to be repressurized is punctured by a needle having a passageway therethrough and both pressurized fluid for repressurizing the article and sealant for sealing the punctured and repressurized article are delivered sequentially and commonly through a single passageway of the needle. Provision is made for shielding the needle against exposure to undesirable accidental puncture and breakage and, by a particular cooperation of relative movement of an article and the needle, for avoiding removal of a plug of material from the article during puncture.

16 Claims, 7 Drawing Figures

APPARATUS AND METHOD FOR REPRESSURIZING HOLLOW VALVELESS ARTICLES

Hollow valveless articles which are inflated or pressurized prior to initial use have been known and used heretofore. One common and well known example of such an article is a tennis ball, conventionally manufactured by molding rubber materials under conditions which pressurize the interior of the hollow ball. As tennis players know, the liveliness of a conventional tennis ball is accomplished at least in part by such pressurization or inflation, which is maintained prior to use by packaging and storage of such tennis balls in pressurized cans. As is also recognized by tennis players, such tennis balls begin to lose liveliness or bouncing characteristics immediately on removal from pressurized packaging.

While these characteristics of tennis balls which are well known to tennis players will be used hereinafter in discussion of this invention, it is contemplated that the invention may be equally applicable to other hollow valveless articles such as certain other forms of athletic balls. Accordingly, the continuing reference herein to tennis balls is to be read broadly as additionally including other hollow valveless articles to which the apparatus and method of this invention may be adapted.

Others have realized that the useful life of a hollow valveless article such as a tennis ball may be determined by loss of pressurization rather than by other factors prior to the present invention. From such realization, various apparatus and methods have been proposed or developed for attempting to revitalize or restore the liveliness of such articles. However, to the best knowledge of the present inventor, none of the previously proposed arrangements have been acceptable. In particular, prior proposals for repressurization of such articles typically employ two separate needles for puncturing a hollow valveless article to be repressurized or reinflated. One of the needles is used to deliver pressurizing fluid such as compressed air, while the other of the needles is used to deliver a sealant by which sealing of the two punctures is attempted. It has been proposed that the two passageways required be arranged concentrically but the relatively large size of the needle thus required and the manner of application suggested has resulted in failure due to the removal of material which forms the wall of the hollow valveless article.

With the foregoing in mind, it is an object of this invention to successfully accomplish repressurizing hollow valveless articles such as tennis balls and the like by puncturing a ball to be repressurized and thereafter delivering pressurized fluid and sealant into the ball to be repressurized sequentially and commonly through a single passageway. Such sequential and common delivery of pressurized fluid and sealant accomplishes the introduction of the material necessary to seal the puncture while avoiding creation of an oversize puncture.

Yet a further object of this invention is the repressurizing of hollow valveless articles such as tennis balls and the like by a method which includes guiding a ball to be repressurized along a predetermined straight-line path while penetrating the ball with a needle having a sharpened end portion lying along the line skewed relative to the straightline path. Such an angular, skewed relation between the sharpened end portion of the needle and the path of movement of the hollow valveless article to be repressurized minimizes the possibility of removal of material from the wall of the article during puncturing.

Some of the objects of the invention having been stated, other objects will appear as the description proceeds, when taken in connection with the accompanying drawings, in which FIG. 1 is a perspective view of an apparatus in accordance with this invention;

While the present invention will be described hereinafter with more particular reference to the accompanying drawings, it is to be recognized at the outset of this description that the description and drawings are directed to the best mode for practice of this invention contemplated by the inventor at the time the description and drawings were prepared. It is contemplated that the apparatus and method may take specific forms which may differ in detail from the description and drawings and, accordingly, the description and drawings are to be understood broadly as an enabling disclosure and not as restrictive on the true scope of this invention.

Figure 1:
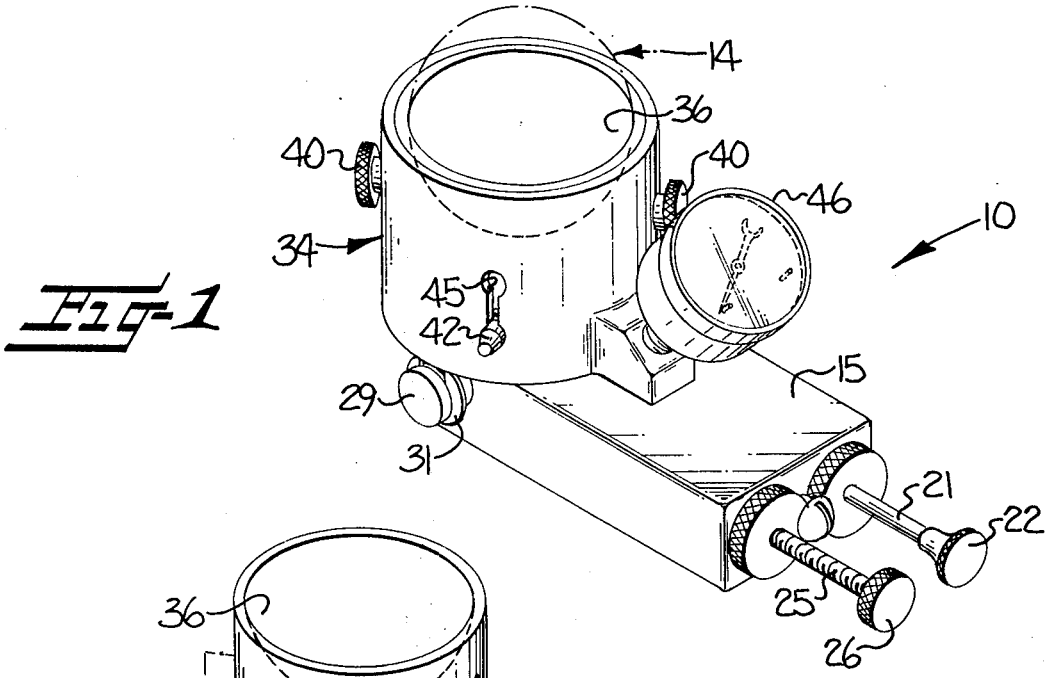
Figure 2:
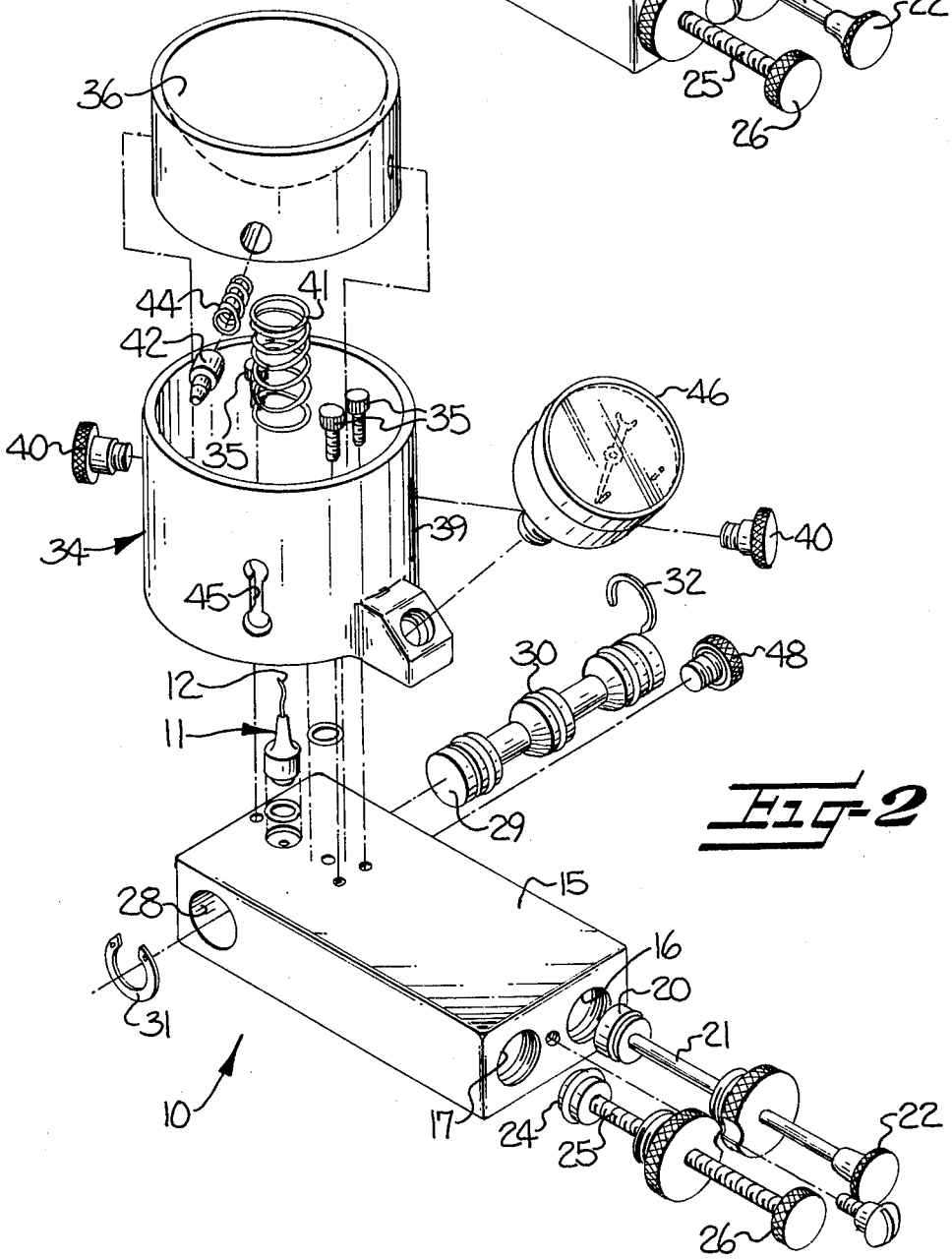
FIG. 2 is a view similar to FIG. 1, exploded to show a number of the components of the apparatus of FIG 1.
Figure 3:
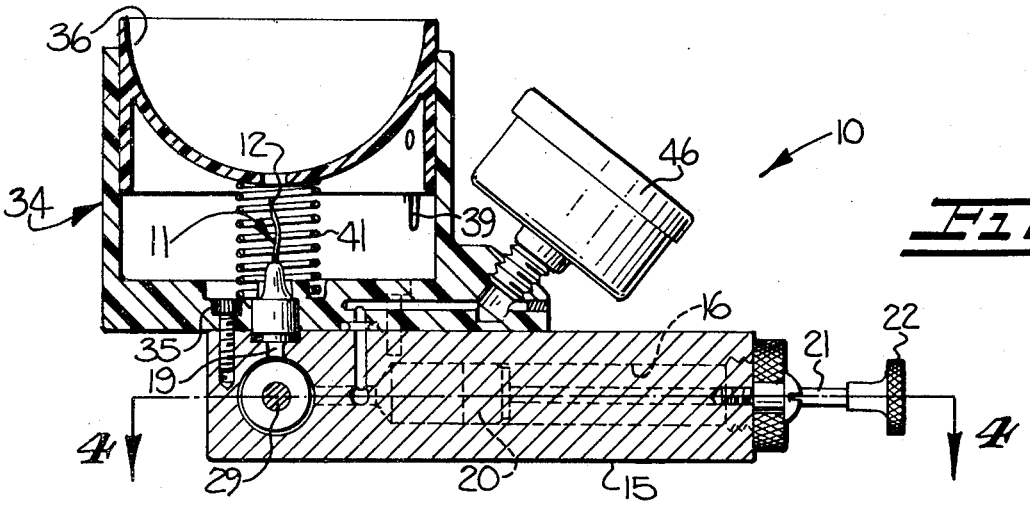
FIG. 3 is an elevation view, partially in section, of the apparatus of FIG. 1.
Figure 7:
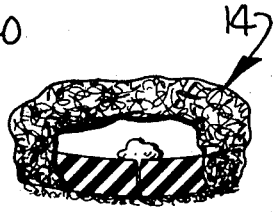
FIG. 7 is an enlarged view of a portion of a tennis ball, partially broken away, illustrating a body of sealant in place following repressurization of the tennis ball in accordance with this invention.

In the drawings, the apparatus of this invention is generally indicated at 10 and includes needle means generally indicated at 11 for puncturing an article to be repressurized. Preferably, the needle means 11 has a sharpened end portion 12 for puncturing a ball (indicating in phantom lines in FIGS. 1 and 5 and at 14 in FIGS. 6 and 7). The sharpened end portion 12 extends along a particular longitudinal axis as described more fully hereinafter and, preferably, has been slightly bent (FIGS. 2, 3 and 6) for purposes brought out more fully hereinafter.

The needle means 11 is mounted in body means formed, in the illustrated embodiment, by a block member 15. The block member 15 has first and second chambers 16, 17 (FIG. 4) formed therein and an exit passageway 19 with which the needle means 11 communicates for purposes to be brought out more fully hereinafter.

The apparatus 10 further includes means for supplying pressurized fluid for repressurizing a hollow valveless article such as a tennis ball, preferably in the form of manually operable air pump means for pumping air into the punctured ball. The manually operable air pump means desirably takes the form of a plunger 20 mounted on the end of a pump rod 21 for movement within one chamber 16 defined within the block member 15. A handle 22 mounted on the pump rod 21 permits manipulation of the plunger 20 so as to pump air.

Figure 4:
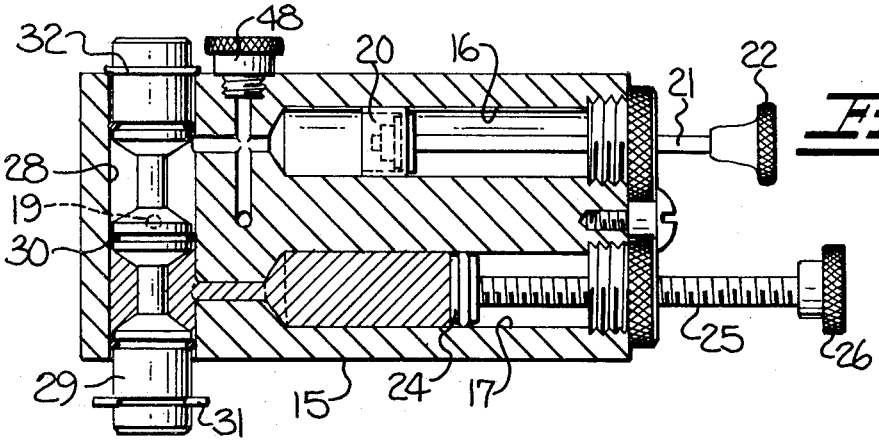
FIG. 4 is a plan view, partially in section, taken substantially along the line 4—4 in FIG. 3.

Also included in the apparatus 10 is means for supplying sealant for sealing a punctured and repressurized ball. In the form illustrated, the means for supplying sealant takes the form of a manually operable expulsion means for expelling sealant through the needle means 11, as exemplified by a plunger 24 mounted on the end of a threaded rod 25 and cooperating with another chamber 17 in the block member 15 (FIG. 4). By rotating the threaded rod 25 by means of a knurled knob 26, sealant (indicated by shade lines in FIG. 4) is expelled from the chamber 17 as brought out more fully hereinafter.

Figure 5:
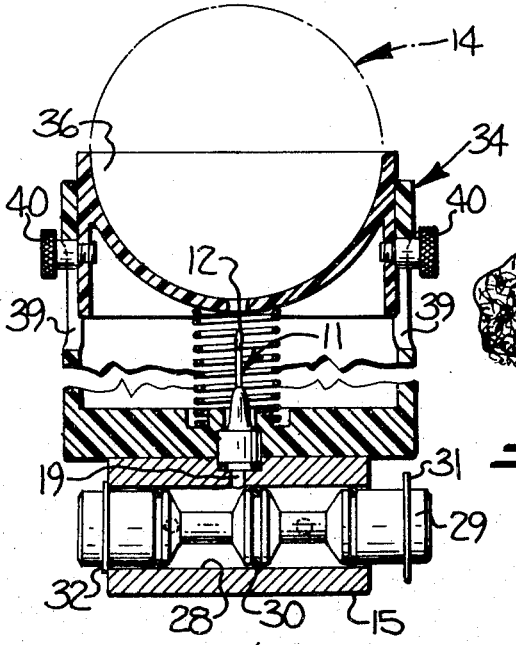
FIG. 5 is an elevation view, partially in section along two angled planes, through a portion of the apparatus of FIG. 1.

Sequential delivery of pressurized fluid and sealant commonly through a single passageway of the needle means 11 is accommodated by the provision of means for alternately establishing operative communication with the needle of a selected one of the supply means. Preferably, and as illustrated in the accompanying drawings, the means for alternately establishing operative communication comprises a slide valve means defined by a crossbore 28 in the block member 15 and a spool member 29 which penetrates the crossbore 28 and is movable relative thereto. The spool member 29 has a central portion bearing a sealing ring 30 and a pair of reduced diameter portions which selectively establish operative communication between the chambers 16, 17 in the block member 15 and the exit passageway 19 (FIGS. 4 and 5). By means of locking rings 31, 32 near the ends of the spool member 29, the stroke of the spool member is limited to that required to establish the alternate operative communication described above.

Mounted on the block member 15 for normally shielding the needle means 11 for exposure to undesirable accidental puncture and breakage, and for other functions brought out more fully hereinafter, is a guard means which preferably takes the form of ball receiving and guiding means. As illustrated, the guard means includes a stationary guiding member 34 secured to the block member 15 by a plurality of threaded fasteners 35 and a ball cup member 36 received within the guide member 34 and thereby mounted for movement relative to the needle means 11. The ball cup member 36 is provided with an opening in the lower portion thereof through which the needle means 11 passes in penetrating a ball (FIGS. 3, 5 and 6) as described more fully hereinafter.

In order to guide a ball engaged in the ball cup member 36 in linear movement toward the needle means 11, the guide member 34 has elongated slots 39 (FIG. 5) therein. The elongate slots 39 are engaged by guide fasteners 40 which restrain the ball cup member 36 and a ball engaging received therein to straight line movement along a predetermined path of travel.

By means of a spring member 41 acting between the ball cup member 36 and the guard member 34, the ball cup member is normally biased toward a position withdrawn from the needle means. Additionally, a manually actuable safety lock is provided by a radial locking pin 42 which moved with the ball cup member 36 relative to the guard member 34. The locking pin 42 is biased outwardly by suitable means such as a spring 44 and lockingly engages enlarged end portions of an elongate slot 45 formed in the guard member 34. As a result, the locking pin 42 must be manually depressed prior to any movement of the ball cup member 36 relative to the needle means 11 and the guard member 34.

In order to gauge the pressure within a repressurized hollow valveless article, a gauge generally indicated at 46 is mounted for operative communication with the one chamber 16 which cooperates with the air pump piston 20. In the form illustrated, operative communication is established by passageways extending through the guard member 34.

For the additional purpose of accommodating inflation of needle valve athletic balls such as basketballs, footballs and the like, a passageway communicating with the one chamber 16 leads to an outer surface of the block member 15 and is closed by a threaded plug 48. When desired, the threaded plug 48 may be removed and replaced by an appropriate flexible tube equipped with a needle, thereby accommodating measured inflation of hollow valved articles such as those described.

Figure 6:
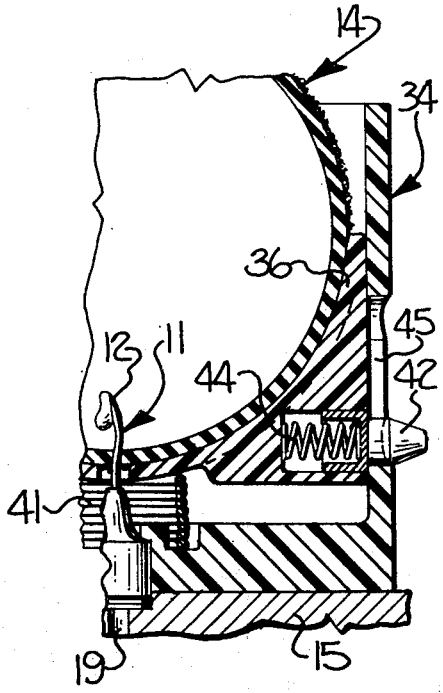
FIG. 6 is an enlarged view similar to FIG. 5 illustrating the delivery of sealant into a punctured and repressurized tennis ball.

In use, the tennis ball 14 or other hollow valveless article to be repressurized is engagingly received within the ball cup member 36. The locking pin 42 is then moved to a retracted position, permitting the ball cup member 36 and the ball 14 engagingly received therewithin to be pressed toward the needle means 11. As the ball to be repressurized is moved relative to the needle, the ball is guided along the predetermined straight line path and penetration of the ball occurs along a line skewed relative to that straight line path due to the angulation of the sharpened end portion of the needle means 11 (FIG. 6). By such angulation, the sharpened end portion of the needle makes a puncture of minimum cross-sectional area. In this manner, the possibility of removing or cutting a "plug" of material from the wall of the hollow article (such as would occur with a simple coaxial or codirectional penetration of the wall by a hollow needle) is avoided. It is believed that such "hooding" of the open end of the needle contributes to the successful accomplishment of the objects of this invention by the apparatus and method which are here described.

With the ball cup member 36 locked in the lower position and the ball to be repressurized penetrated by the needle means 11, the pressure within the ball may be read on the gauge 46 and the air pump handle 22 may be manipulated as required to inflate the ball to the desired pressure or to an intermediate pressure. Thereafter, the spool 29 may be shifted (to the left in FIG. 5) to establish operative communication between the sealant chamber 17 and the interior of the ball 14 being repressurized. By manipulation of the knurled knob 26, the desired quantity of sealing material may be discharged through the needle means 11 into the interior of the ball 14 (FIG. 6). The spool member 29 may then be returned to the alternate position, for rechecking the pressurization of the ball or, if desired, for delivery of further air into the ball. On completion of pressurization and sealant delivery, the ball cup member 36 is released for return to the withdrawn position and pressurization within the ball 14 will cause sealant to occlude and seal the opening by which the needle means 11 penetrated the ball or other hollow article.

It will be understood that pressurization of the hollow article may alternatively go to the desired final pressure prior to introduction of sealant or only after introduction of sealant. In the latter instance, delivery of additional pressurizing fluid after the delivery of sealant may assure that the common passageway through the needle means 11 is cleared prior to storage of the apparatus 10 and thus may be deemed desirable.

In the drawings and specification, there has been set forth a preferred embodiment of the invention, and although specific terms are employed, they are used in a generic and descriptive sense only and not for purposes of limitation.

That which is claimed is:

1. Apparatus for repressurizing hollow valveless balls and the like comprising needle means for puncturing a ball to be repressurized and having a single passageway therethrough, means for supplying pressurized fluid for repressurizing a ball, means for supplying sealant for sealing a punctured and repressurized ball, and means for alternately establishing operative communication of a selected one of said means for supplying pressurized fluid and said means for supplying sealant with said single passageway of said needle means whereby pressurized fluid and sealant are delivered sequentially and commonly through said single passageway into a ball to be repressurized.

2. Apparatus according to claim 1 wherein said means for supplying pressurized fluid comprises manually operable air pump means for pumping air into a punctured ball.

3. Apparatus according to claim 1 wherein said means for supplying sealant comprises manually operable expulsion means for expelling sealant through said needle means.

4. Apparatus according to claim 1 wherein said means for alternately establishing operative communication comprises slide valve means having a bore operatively communicating with each of said needle means, said means for supplying pressurized fluid and said means for supplying sealant, and a valve member slideably mounted in said bore.

5. Apparatus according to claim 1 further comprising gauge means operatively communicating with said means for supplying pressurized fluid for indicating pressure conditions within a ball being repressurized.

6. Apparatus according to claim 1 further comprising ball receiving and guiding means mounted for movement adjacent said needle means and for engaging a ball to be repressurized and guiding an engaged ball in linear movement during penetration thereof by said needle means.

7. Apparatus according to claim 6 wherein said needle means has a sharpened end portion for puncturing a ball and which extends along a longitudinal axis and further wherein said ball receiving and guide means is mounted relative to said needle means for guiding a ball to be punctured along a line skewed relative to said longitudinal axis during penetration thereof by said needle means.

8. Apparatus according to claim 6 further comprising releasable means for normally locking said ball receiving and guiding means in a position withdrawn from said needle means, said releasable means being actuable to permit movement of said ball receiving and guiding means relative to said needle means.

9. Apparatus for repressurizing hollow valveless athletic balls such as tennis balls and the like comprising needle means for puncturing a ball to be repressurized and having a passageway therethrough, ball cup means mounted for movement relative to said needle means for receiving a ball to be repressurized and for guiding a received ball in linear movement toward said needle means, means normally biasing said ball cup means toward a position withdrawn from said needle means, said ball cup means normally shielding said needle means from exposure to undesirable accidental puncture and breakage, means for supplying pressurized air for repressurizing a ball, means for supplying sealant for sealing a punctured and repressurized ball, and means for alternately establishing operative communication of a selected one of said means for supplying air and said means for supplying sealant with said passageway of said needle means whereby pressurized air and sealant are delivered sequentially and commonly through said passageway into a ball to be repressurized.

10. Apparatus according to claim 9 further comprising means for normally locking said ball cup means in said withdrawn position and manually actuable to permit movement of said ball cup means relative to said needle means.

11. Apparatus for repressurizing hollow valveless articles such as tennis balls and the like comprising body means defining first and second chambers therein and an exit passageway, needle means mounted on said body means for puncturing an article to be repressurized and having a passageway therethrough communicating with said exit passageway of said body means, said needle means having a sharpened end portion which extends along a longitudinal axis, guard means mounted on said body means for normally shielding said needle means from exposure to undesirable accidental puncture and breakage, said guard means being mounted for movement relative to said needle means and engagingly receiving an article to be repressurized, means mounting said guard means for linear movement relative to said needle means and for guiding an engagingly received article along a line skewed relative to said longitudinal axis during puncturing thereof, means cooperating with one of said first and second chambers of said body means for pumping therethrough air for repressurizing a punctured article, means cooperating with the other of said first and second chambers of said body means for expelling therefrom sealant for sealing a punctured repressurizing article, and valve means in said body for selectively establishing operative communication of said chambers with said exit passageway whereby pressurized air and sealant are delivered sequentially and commonly through said passageway into an article to be repressurized.

12. A method of repressurizing hollow valveless balls and the like comprising penetrating a ball to be repressurized with a needle defining a single common passageway while delivering sequentially through the common passageway and into the ball pressurized fluid for repressurizing the ball and sealant for sealing the site of the penetration and then withdrawing the needle.

13. A method according to claim 12 wherein the penetrating comprises guiding a ball to be repressurized along a predetermined straight line path while moving the ball relative to the needle.

14. A method according to claim 13 wherein the penetrating further comprises penetrating the ball to be repressurized along a line skewed relative to the straight line path.

15. A method of repressurizing hollow valveless balls and the like comprising penetrating a ball to be repressurized with a needle defining a single common passageway, then delivering through the passageway and into the ball pressurized fluid for repressurizing the ball, and then delivering through the same passageway and into the repressurized ball sealant for sealing the repressurized ball against leakage of pressurized fluid therefrom, and then withdrawing the needle.

16. A method of repressurizing hollow valveless balls and the like comprising puncturing a ball to be repressurized, then delivering through a passageway and into the punctured ball pressurized fluid for pressurizing the ball to an intermediate elevated pressure, then delivering through the same passageway and into the punctured ball sealant for sealing the repressurized punctured ball against the leakage of pressurized fluid therefrom, and then delivering through the same passageway and into the punctured ball pressurized fluid for pressurizing the ball to a final elevated pressure while cleaning the passageway of any sealant remaining therein.

* * * * *

UNITED STATES PATENT OFFICE

CERTIFICATE OF CORRECTION

PATENT NO. : 3,974,622

DATED : August 17, 1976

INVENTOR(S) : Fred Stubblefield

It is certified that error appears in the above-identified patent and that said Letters Patent are hereby corrected as shown below:

Column 3, Line 34, "for" should be -- from --;
Column 3, Line 50, "elongated" should be -- elongate --;
Column 3, Line 53, "engaging" should be -- engagingly --;
Column 6, Line 41, "repressurizing" should be -- repressurized --;
Column 8, Line 2, delete "the"

Signed and Sealed this

Sixteenth Day of November 1976

[SEAL]

*Attest:*

RUTH C. MASON
*Attesting Officer*

C. MARSHALL DANN
*Commissioner of Patents and Trademarks*